United States Patent [19]

Sommers

[11] 4,281,768

[45] Aug. 4, 1981

[54] ASSAY TUBE RACK

[76] Inventor: Philip B. Sommers, 923 Garden Rd., Orange, Conn. 06477

[21] Appl. No.: 65,465

[22] Filed: Aug. 10, 1979

[51] Int. Cl.[3] ..... A47F 7/00

[52] U.S. Cl. ..... 211/74

[58] Field of Search ..... 211/71, 72, 73, 74, 211/60 R; D24/32; 422/104

[56] References Cited

U.S. PATENT DOCUMENTS

| | | | |
|---|---|---|---|
| 334,492 | 1/1886 | Valentin | 211/60 R X |
| 3,379,315 | 4/1968 | Broadwin | 211/72 |
| 3,532,221 | 10/1970 | Raluhiokalani et al. | 211/71 X |
| 3,604,566 | 9/1971 | Rem et al. | 211/74 |
| 3,778,232 | 12/1973 | McMorrow | 211/74 X |
| 4,124,122 | 11/1978 | Emmitt | 211/74 |

*Primary Examiner*—Roy D. Frazier
*Assistant Examiner*—Robert W. Gibson, Jr.
*Attorney, Agent, or Firm*—William W. Jones

[57] ABSTRACT

An assay tube rack which includes means for holding the assay tubes disposed therein in visually discernable groups wherein each assay tube in each group will be visible in elevation when the rack is viewed from a predetermined direction. The groups of tubes may consist of two or more tubes. The combination of discernable tube groups plus visibility of each assay tube in each group makes the rack particularly useful in performing titration tests on specimens contained in the tubes, as for example, in radioimmunoassay testing.

2 Claims, 6 Drawing Figures

ASSAY TUBE RACK

This invention relates to an assay tube rack which is particularly useful in performing titration testing of a plurality of specimens held in assay tubes contained in the rack.

Most assay tube racks disclosed in the prior art are constructed so that the tubes held in the racks are arrayed in a column of rows of tubes. In such an arrayment, each tube in each row of the column is directly behind a corresponding tube in an adjacent row. With such a rack, the individual tubes are not readily accessible since the addition of specimen and reagents to any given tube may be hindered by tubes placed in front of such given tube. This lack of accessibility can render it difficult to add, in a precise and accurate manner, small amounts of specimen or reagent which are generally delivered to the bottom section of the assay tube.

When performing clinical tests on specimens, as, for example, when performing radioimmunoassay tests on blood serum samples, the preferred practice, for accuracy purposes, is to perform the test on duplicate samples of the same specimen standard material. Again, for accuracy, the duplicate tests should be performed side-by-side, at the same time. Since a multiplicity of specimens will be handled by a technician during one analysis, the technician will have before him or her a relatively large number of assay tubes, all of which are held in one or more assay tube racks. It will be appreciated that use of the conventional assay tube racks in connection with such high volume testing can create possible problems with regard to specimen identity since, when adding a specimen or reagent, it is difficult to differentiate one assay tube from another. In addition, removal or rearrangement of the assay tubes, or at least some of them, from the rack during testing wastes time and can create the possibility of specimen mix-up since it is difficult to differentiate one assay tube from another. Also, the pairing of assay tubes is not facilitated with the prior art racks, whereby errors in associating pairs of assay tubes can occur.

I have invented an assay tube rack which includes provisions for automatically pairing assay tubes together so that there will be no error in properly associating the specimen samples in a pair of tubes. Provision is also made, in one embodiment, for associating with each assay tube pair, a specimen source tube. In addition to the above, my new rack has provisions for enabling the technician to see each assay tube in full elevation, within the rack, in any grouping of tubes which are being tested, so that the testing may be done without the necessity of removing or rearranging any of the tubes in the racks.

It is, therefore, an object of this invention to provide an assay tube rack having provisions for holding assay tubes in readily discernable and distinguishable groups of two or more assay tubes in each group.

It is a further object of this invention to provide an assay tube rack of the character described wherein each assay tube in each group of an association of groups can be seen in full elevation within the rack by a technician performing tests on specimens contained in the racked tubes.

These and other objects and advantages will become more readily apparent from the following detailed description of preferred embodiments of the assay tube rack of this invention taken in conjunction with the accompanying drawings, in which.

Figure 4:
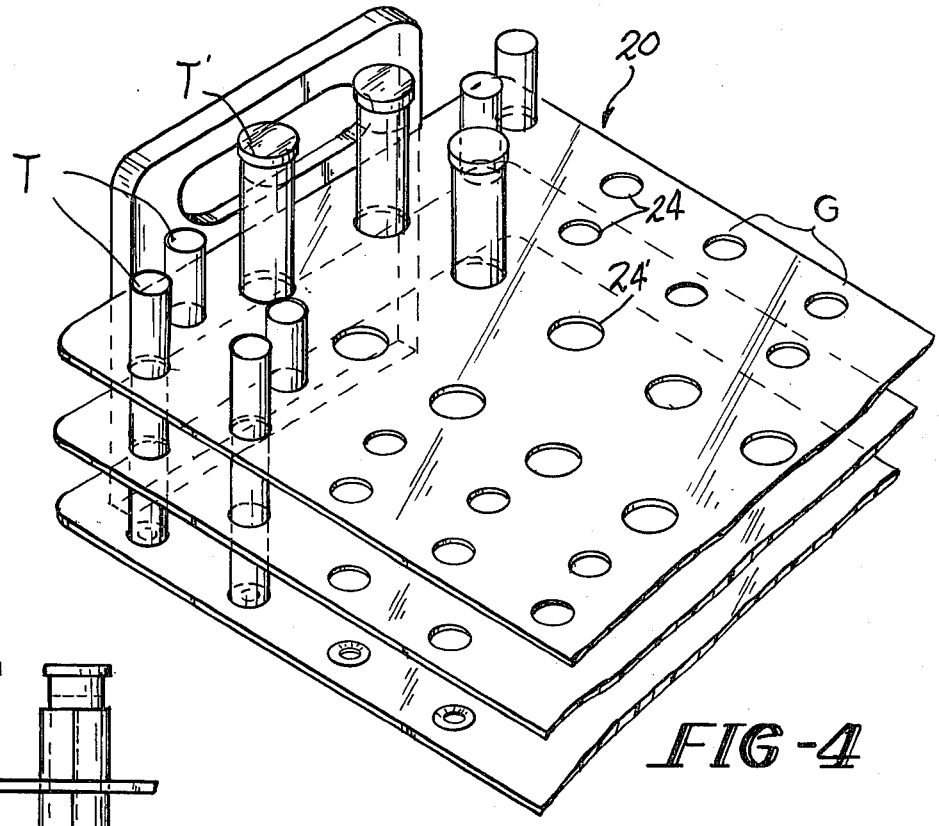
Figure 6:
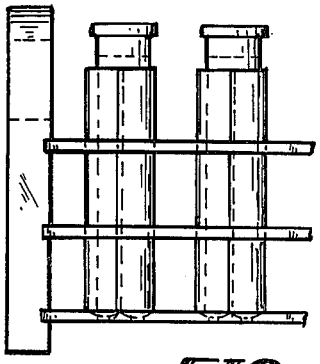
Figure 5:
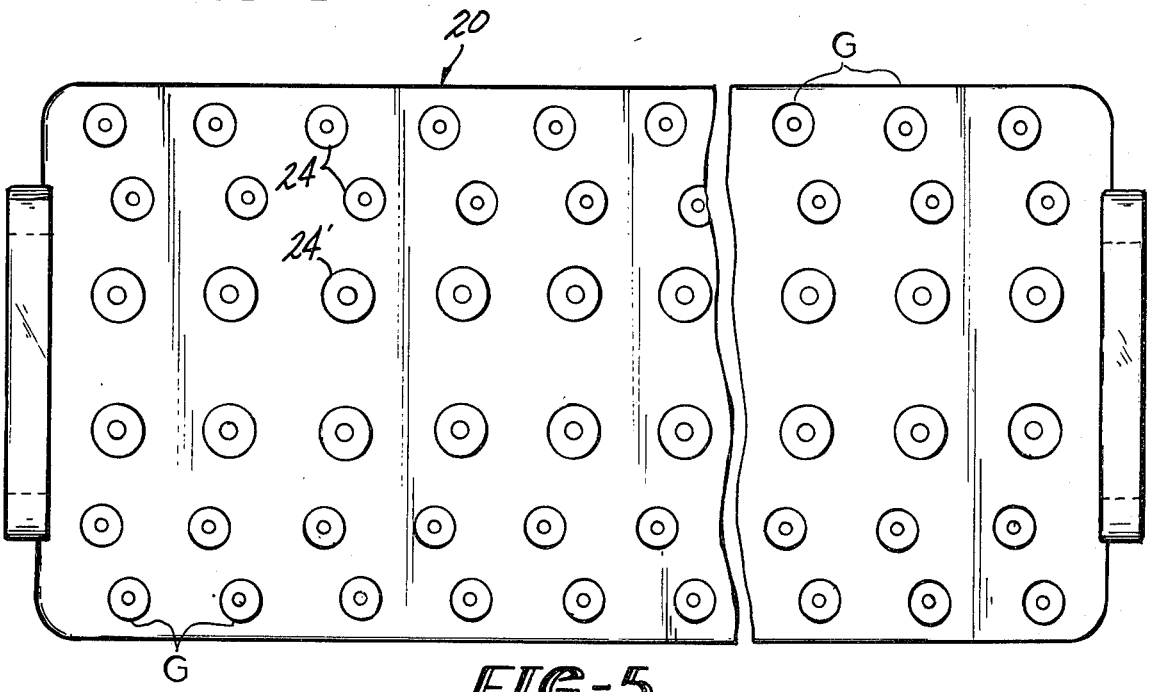

FIG. 4 is a fragmented perspective view of a second embodiment of an assay tube rack formed in accordance with this invention having provision for holding assay tubes therein in two associations of groups of three tubes each, and wherein each of the assay tubes in each group in an association of groups is visible in full elevation by a technician performing tests on specimens in the tubes, and wherein the third tube in each group is a specimen tube from which the specimens being assayed are drawn, there being no need to view the third tube in full elevation;

FIG. 5 is a top plan view of a portion of the rack of FIG. 4, showing hole spacing which forms the tube groups and separates one group from the next while enabling full viewing of each assay tube in a group; and FIG. 6 is an elevational view of a portion of the rack of FIG. 4 showing two adjacent tube groups as they appear to one viewing the rack in front or back elevation.

Figure 1:
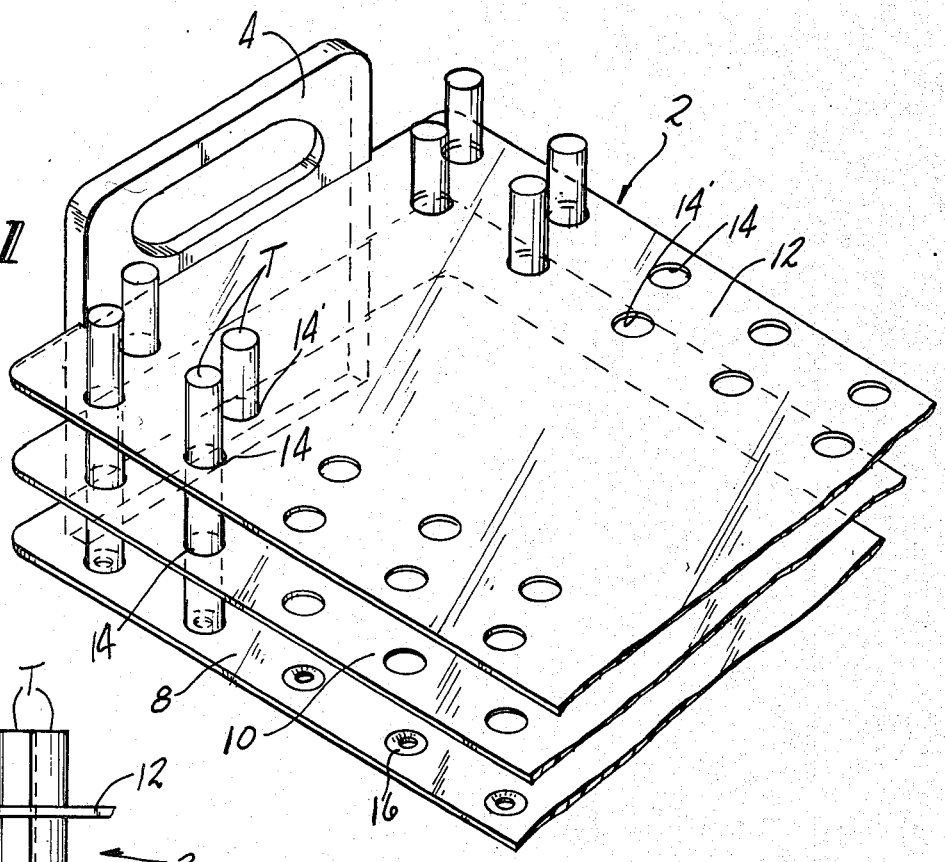
FIG. 1 is a broken perspective view of a first preferred embodiment of an assay tube rack formed in accordance with this invention and having provisions for retaining assay tubes therein in two associations of groups of tubes wherein each group contains two tubes.

Referring now to the drawings, there is shown in FIG. 1 an embodiment of an assay tube rack denoted generally by the numeral 2. The rack 2 includes upstanding end walls 4 and 6 between which extends a base 8, an intermediate support member 10, and an upper support member 12. The front and rear sides of the rack 2 are open so that the tubes T which are disposed in the rack can be seen when the rack is viewed in front or rear elevation. Each of the support members 10 and 12 is provided with pairs of aligned openings 14 and 14', the numeral 14 being used to designate the opening nearest a side of the rack 2, and the numeral 14' being used to designate the opening further inwardly away from the corresponding side of the rack 2. Recesses 16 are provided in the base 8 for nesting of the bottoms of the assay tubes T.

It will be noted that the openings 14 and 14' are arranged in distinct groups G of two openings each, and that the openings 14' are obliquely positioned with respect to the openings 14 in each group G. It will be further noted that there are two associations or rows A and A' of groups G of the openings 14 and 14', one association of groups being disposed on each open side of the rack 2.

Figure 3:
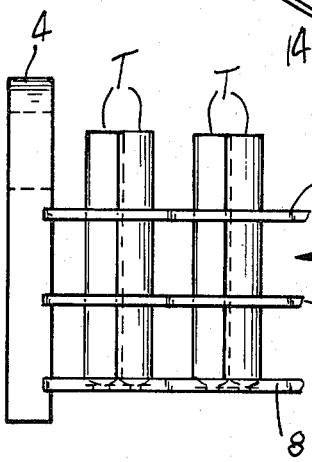
FIG. 3 is an elevational view of a portion of the rack of FIG. 1 and illustrating the appearance of two adjacent tube groups in one association, as such groups appear to a technician viewing the rack in front or back elevation.
Figure 2:
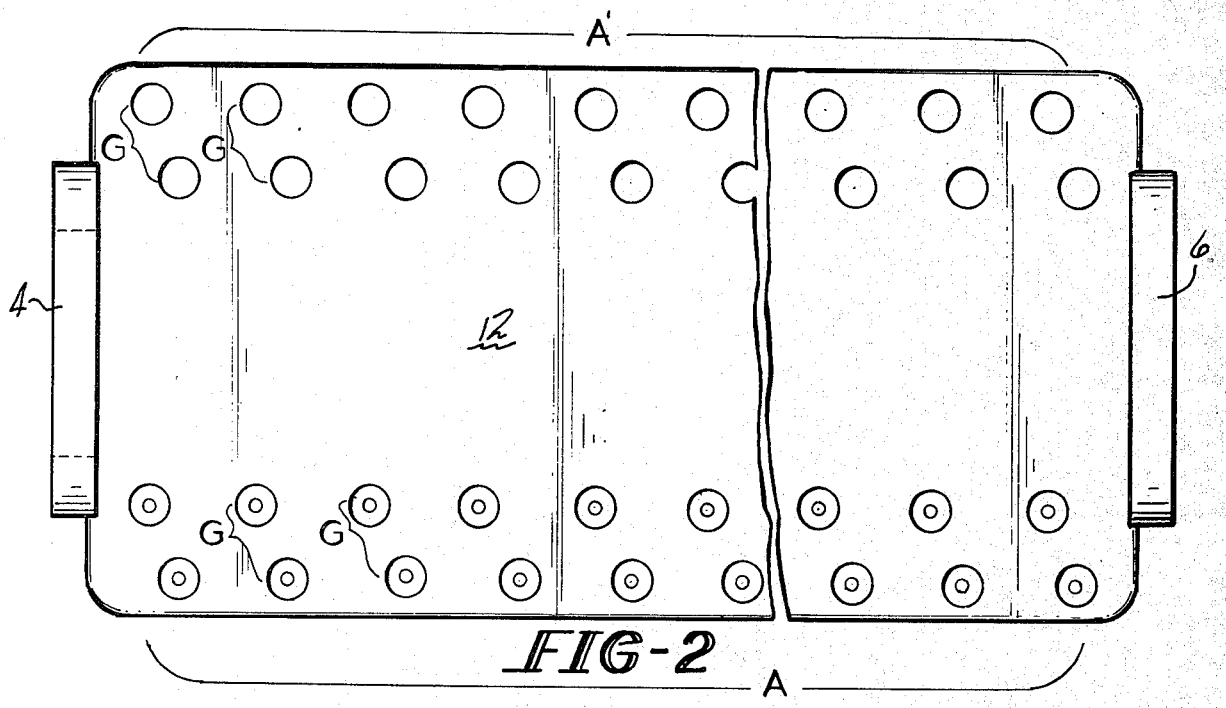
FIG. 2 is a top plan view of the rack of FIG. 1.

FIG. 3 clearly illustrates that the assay tubes T held in the rack 2 are clearly discernable as being arranged in distinct pairs, and that each tube T in each pair is clearly visible in full elevation when the rack 2 is viewed looking directly at one or the other of the open sides. Thus, all of the tubes T disposed in the respective associations A or A' can be clearly viewed in full elevation by one looking directly at the respective open side of the rack 2.

Use of the rack 2 in performing laboratory analysis of specimens is as follows. Duplicate samples of all specimens, controls and standards to be tested are deposited in paired assay tubes, which have been placed in the support opening groups G in the rack 2. The possibility of confusing one of a pair of duplicate samples with one of another pair of duplicate samples is thus eliminated since the pairing of samples is clearly visible. The analysis or assay is then performed on all of the specimens, in duplicate, in an accurate and precise manner, without the need of removing or rearranging any of the tubes in the rack since all of the assay tubes are clearly visible in full elevation and readily accessible. In addition, color changes or the like caused by the analysis can be clearly observed. The use of two or more associations of groups in the rack enables more analyses to be made before the rack must be emptied of specimens, since the technician works his way through one association, turns the rack around, and then works his way through another association.

Referring now to FIGS. 4–6, a second embodiment to a tube rack formed in accordance with my invention is disclosed. The rack, designated generally by the numeral 20, is constructed similarly to the rack 2 previously described, with the exception that each group G of openings 24 and 24' contains three openings rather than two. The third opening holds a specimen tube and is disposed perferably behind the assay tube openings, whereby the length of the rack is not unduly large. Each group of three openings is spaced apart from the adjacent group or groups so that, when viewed in elevation, the tubes in each group will be clearly associated with each other and clearly separated from the adjacent group or groups of tubes. The tubes T contained in the openings 24 are the assay tubes which contain the specimen samples to be analysed, and the tube T' in the opening 24' is a larger tube which contains the larger amount of the specimen from which the samplings were taken. Alternatively, the tube T' could be a reagent tube, or the like. FIG. 5 shows the plan layout of the groups of openings, and FIG. 6 shows the elevation view of two adjacent groups of tubes, showing the concurrent definite continuity of individual tubes within each group G, and the definite separation of adjacent groups, one from the other. It will be understood that the mode of use of the rack 20 is similar to the previously described mode of use of the rack 2.

Iclaim:

1. In an assay tube rack of the type having supporting means for holding a plurality of assay tubes and having opposed open sides, the improvement comprising: means forming associations of holes in said rack, there being one association of said holes traversing each of said opposed open sides of said rack; each of said associations of holes comprising distinctly separated groups of holes consisting of three holes in each group, wherein a first hole in each group is disposed closely adjacent to a respective side of said rack, a second hole in each group is disposed more remote from said respective side of said rack than said first hole with the axis of said second hole being laterally offset from the axis of said first hole, and a third hole in said group is disposed more remote from said respective side wall than said second hole with the axis of said third hole being disposed between parallel line projections of the axes of said first and second holes, and wherein a side of said first hole in one group is laterally offset from an adjacent side of said second hole in an adjacent group thereby providing a distinct grouping of assay tubes when the groups of holes in said rack are filled with assay tubes.

2. The assay tube rack of claim 1, wherein, in each group, opposite sides of said third hole are contained within parallel projections of the outermost sides of said first and second holes in the same group.

* * * * *